US012345054B2

(12) United States Patent
Douglas et al.

(10) Patent No.: US 12,345,054 B2
(45) Date of Patent: Jul. 1, 2025

(54) FLOOR SUPPORT SYSTEM

(71) Applicant: RYNO LTD, Cranleigh (GB)

(72) Inventors: Andrew Douglas, Aberdeen (GB); Caleb White, Ellon (GB)

(73) Assignee: RYNO LTD, Cranleigh (GB)

( * ) Notice: Subject to any disclaimer, the term of this patent is extended or adjusted under 35 U.S.C. 154(b) by 155 days.

(21) Appl. No.: 18/033,417

(22) PCT Filed: Oct. 15, 2021

(86) PCT No.: PCT/EP2021/078624
§ 371 (c)(1),
(2) Date: Apr. 24, 2023

(87) PCT Pub. No.: WO2022/084184
PCT Pub. Date: Apr. 28, 2022

(65) Prior Publication Data

US 2024/0003141 A1 Jan. 4, 2024

(30) Foreign Application Priority Data

Oct. 22, 2020 (GB) ..... 2016794

(51) Int. Cl.
*E04F 15/024* (2006.01)

(52) U.S. Cl.
CPC .. *E04F 15/02452* (2013.01); *E04F 15/02464* (2013.01)

(58) Field of Classification Search
CPC ..... E04F 15/02452; E04F 15/02464
See application file for complete search history.

(56) References Cited

U.S. PATENT DOCUMENTS 2,891,492 A * 6/1959 Gerosa ..... E04D 11/00 52/390
4,835,924 A * 6/1989 Blacklin ..... E04D 11/005 52/263
4,996,804 A * 3/1991 Naka ..... E04F 15/02482 52/126.6
6,625,951 B1 9/2003 McCarthy
7,140,156 B1 11/2006 Lowe et al.
9,499,993 B1 * 11/2016 Kugler ..... E04F 15/0247
2002/0026757 A1 * 3/2002 Scissom ..... E04F 15/02429 52/262
2002/0121583 A1 * 9/2002 Jones ..... E01C 5/223 248/188
2004/0261329 A1 * 12/2004 Kugler ..... E04F 15/0247 52/126.6

(Continued)

FOREIGN PATENT DOCUMENTS

AU 2010100928 A4 9/2010
DE 102015112516 A1 2/2016

(Continued)

OTHER PUBLICATIONS

WIPO, International Search Report for PCT/EP2021/078624, Jan. 25, 2022.
IPO, Search Report for GB2016794.6, Feb. 8, 2022.

*Primary Examiner* — Theodore V Adamos
(74) *Attorney, Agent, or Firm* — Hodgson Russ LLP

(57) ABSTRACT

A paving support system comprising flooring support members (100) having upturned tabs for spacing apart flooring members such as paving slabs.

19 Claims, 7 Drawing Sheets

(56) References Cited

U.S. PATENT DOCUMENTS

2017/0350141 A1* 12/2017 Kugler ..... E04F 15/02476

FOREIGN PATENT DOCUMENTS

| | | | |
|---|---|---|---|
| EP | 0133839 | | 3/1985 |
| FR | 1581634 | | 9/1969 |
| GB | 1307772 | | 2/1973 |
| KR | 20190024234 | A * | 3/2019 |
| WO | 2008063438 | A2 | 5/2008 |

* cited by examiner

FLOOR SUPPORT SYSTEM

TECHNICAL FIELD

The present invention relates to a floor support system. More specifically, the present invention relates to a pedestal system for supporting paving slabs.

BACKGROUND ART

It is known to create an elevated floor comprising a plurality of supports (pedestals) which hold a plurality of tessellating floor panels above an underlying surface. These panels may be in the form of decking (i.e. elongate panels such as wooden or composite planks) or paving (square/rectangular panels constructed from e.g. stone). Many pedestals are known in the field, and cover a range of heights from the underlying surface. Some pedestals are constructed from moulded plastic material, and may be height adjustable, for example comprising two threaded components that may be adjusted to a desired height.

In many applications there is a need to provide flooring systems that are fire resistant. This has led to the development of more systems constructed primarily from metal materials.

A problem with many known pedestals is that they are not suitable for low height applications. In some applications, there is minimal available clearance from the underlying surface to the required floor, and as such there may be only a small vertical space in which to provide support. Such spaces may be as low as 10 mm, and up to 24 mm. Many existing pedestal systems are not able to fit into such a space (the lowest they typically go to is 25 mm).

It is an aim of the invention to overcome, or at least mitigate, at least one of the aforementioned problems.

SUMMARY OF INVENTION

According to a first aspect of the invention there is provided a stackable flooring support component comprising a lower support surface and an upper support surface, the component shaped such that:

when two such identical, stackable flooring support components are stacked in a first angular orientation the stackable flooring support components nest together to provide a first support height between the lower support surface of the lower component and the upper support surface of the upper component; and, when two such identical, stackable flooring support components are stacked in a second angular orientation the stackable flooring support components provide a second support height between the lower support surface of the lower component and the upper support surface of the upper component, wherein the second support height is greater than the first support height.

Advantageously, the provision of a stacking arrangement of this kind provides low part variability, a high degree flexibility and the ability to provide incremental changes in support height.

Preferably the stackable flooring support component is constructed from a sheet material.

Preferably the stackable flooring support component is constructed from sheet metal.

Preferably the stackable flooring support component comprises a perimeter support portion and a base support portion, the perimeter support portion surrounding the base support portion and being offset therefrom such that:

in the first angular orientation the base support portion of the upper flooring support component enters the perimeter support portion of the lower flooring support component; and, in the second angular orientation the base support portion of the upper flooring support component abuts the perimeter support portion of the lower flooring support component.

Preferably a plurality of upstanding tabs are provided.

Preferably the tabs are provided adjacent corresponding openings in the stackable flooring support component such that in the first angular orientation the tabs of the lower flooring support component enter the openings of the upper flooring support component.

Preferably there is provided a further set of openings oriented at a first angle to the tab openings, wherein the second angular orientation is at the first angle to the first angular orientation such that the tabs of the lower flooring support component enter the further set of openings of the upper flooring support component in the second angular orientation.

Preferably the tabs are deformable to enable two stackable flooring support components to be locked together by deformation of the tabs of the lower stackable flooring support component projecting through the further set of openings of the upper flooring support.

According to a second aspect there is provided a kit for forming a flooring support, the kit comprising a plurality of base components according to any preceding claim.

According to a third aspect there is provided a method of supporting a plurality of flooring members, the method comprising the step of:

forming a plurality of spaced apart flooring supports, each flooring support comprising one or more stackable flooring support components according to the first aspect, the flooring supports being formed by selecting one or more flooring support components, and stacking the flooring support components to the desired height by orienting them in the first or second angular orientation;

placing a plurality of flooring members on the plurality of flooring supports.

The present invention is particularly well suited to flooring members of the paving type.

According to a fourth aspect of the invention there is provided a support for a plurality of flooring members, the support comprising:

a first base component having a ground contact surface and a plurality of tabs projecting upwardly in use;

a first shim defining a support surface for placement of a flooring member and comprising a plurality of openings;

wherein the first shim is stacked on top of the first base component such that the tabs project through the openings to retain the first shim relative to the first base component, the tabs forming flooring member abutments projecting from the support surface.

Advantageously, the providing of a base with tabs and shims provides a low-height solution whose height can be easily adjusted by stacking.

Preferably there is provided a second shim positioned stacked between the first base and the first shim, the second shim being identical to the first shim.

Preferably the first base component is square in cross-section, and in which four tabs are defined mid-way along and inboard of each side edge of the first base component.

Preferably the base component comprises four pairs of tabs, each pair of tabs being aligned mid-way along and inboard of each side edge, each pair of tabs comprising an inner tab and an outer tab.

Preferably the tabs project at an angle from the upper surface of the base component in use, and wherein the inner and outer tabs project towards each other.

Preferably the tabs project at 45 degrees to the upper surface of the base component in use.

Preferably the base comprises a raised inner portion defining part of a shim support surface, and a raised outer portion defining part of the shim support surface, the raised inner portion and raised outer portion being separated by an annular base portion defining the ground contact surface.

Preferably the first base component is constructed from a sheet material.

Preferably the tabs are constructed from locally deformed portions of the first base component.

Preferably the base is constructed from sheet metal material.

According to a fifth aspect there is provided a kit for forming a flooring support, the kit comprising:

a first base component having a ground contact surface and a plurality of tabs projecting upwardly in use;

at least one shim defining a support surface for placement of a flooring member and comprising a plurality of openings;

wherein at least one shim is stackable on top of the first base component such that the tabs project through the openings to retain the at least one shim relative to the first base component, the tabs forming flooring member abutments projecting from the support surface of the top shim.

According to a sixth aspect there is provided a support for a plurality of flooring members, the support comprising a first base component constructed from a shaped sheet material, the first base component having a first portion defining a ground contact surface, a second portion defining a flooring support surface and a plurality of tabs projecting upwardly from the flooring support surface to serve as flooring member abutments in use.

Preferably the first base component is square in cross-section, and in which four tabs are defined mid-way along and inboard of each side edge of the first base component.

Preferably the first base component comprises four pairs of tabs, each pair of tabs being aligned mid-way along and inboard of each side edge, each pair of tabs comprising an inner tab and an outer tab.

Preferably the tabs project at an angle from the upper surface of the first base component in use, and wherein the inner and outer tabs project towards each other.

Preferably the tabs project at 45 degrees to the upper surface of the first base component in use.

Preferably the first base comprises a raised inner portion defining part of the flooring support surface, and a raised outer portion defining part of the flooring support surface, the raised inner portion and raised outer portion being separated by an annular first base portion defining the ground contact surface.

Preferably the tabs are constructed from locally deformed portions of the first base component.

Preferably the first base component is constructed from sheet metal material.

Preferably there is provided a set of apertures configured to receive the tabs of a second base component when the first and second base components are stacked on top of each other for form the support.

Preferably the apertures are positioned to receive the tabs of a second base component when the base components are oriented at 45 degrees to each other.

BRIEF DESCRIPTION OF DRAWINGS

Example devices according to the present invention will now be described with reference to the Figures in which.

DESCRIPTION OF THE FIRST EMBODIMENT

Figure 4:
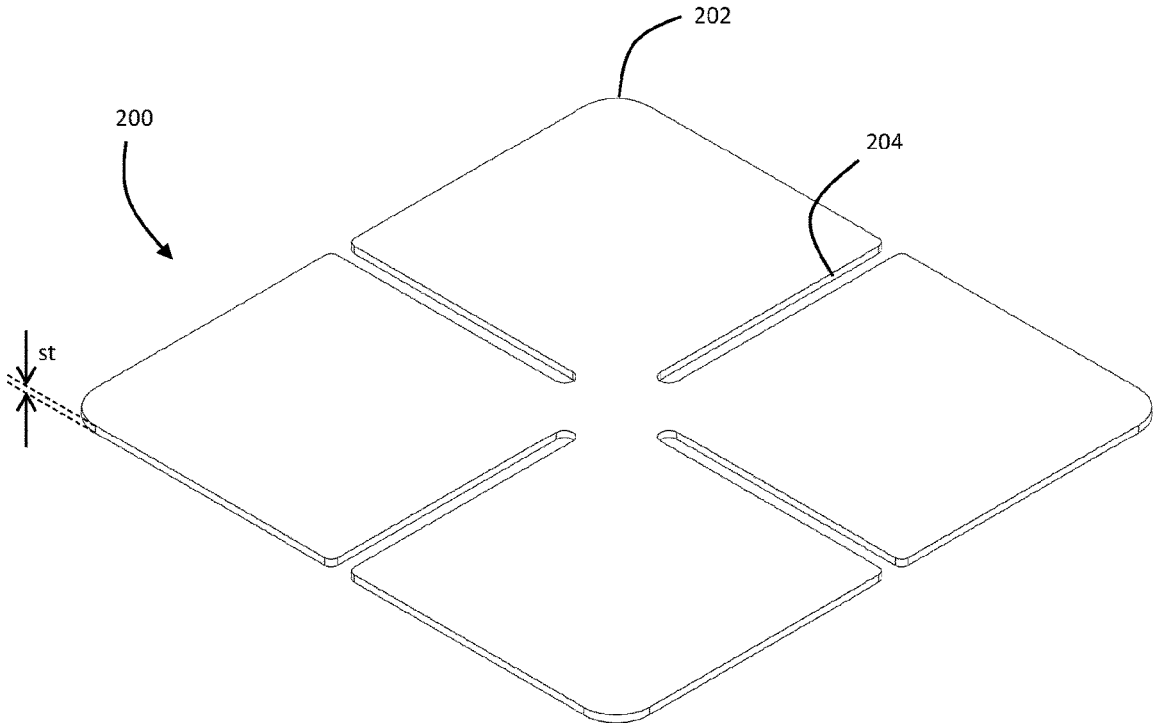
FIG. 4 is a perspective view of a shim plate in accordance with the present invention.

The present invention relates to a low-height paving support (also known as a pedestal). The paving support of the present invention may be constructed in a variety of ways depending on the support height from the underlying substrate to the lower surface of the paving slab as required by the installer. The support system disclosed herein is modular—i.e. various support heights may be configured with the selection of a plurality of components from a kit and the stacking of those components. This kit typically comprises two support bases 100 as shown in FIG. 1, and a plurality (typically four) shims 200 as shown in FIG. 4.

The different support configurations that may be formed from such a kit are described below.

First Support Configuration

Figure 1:
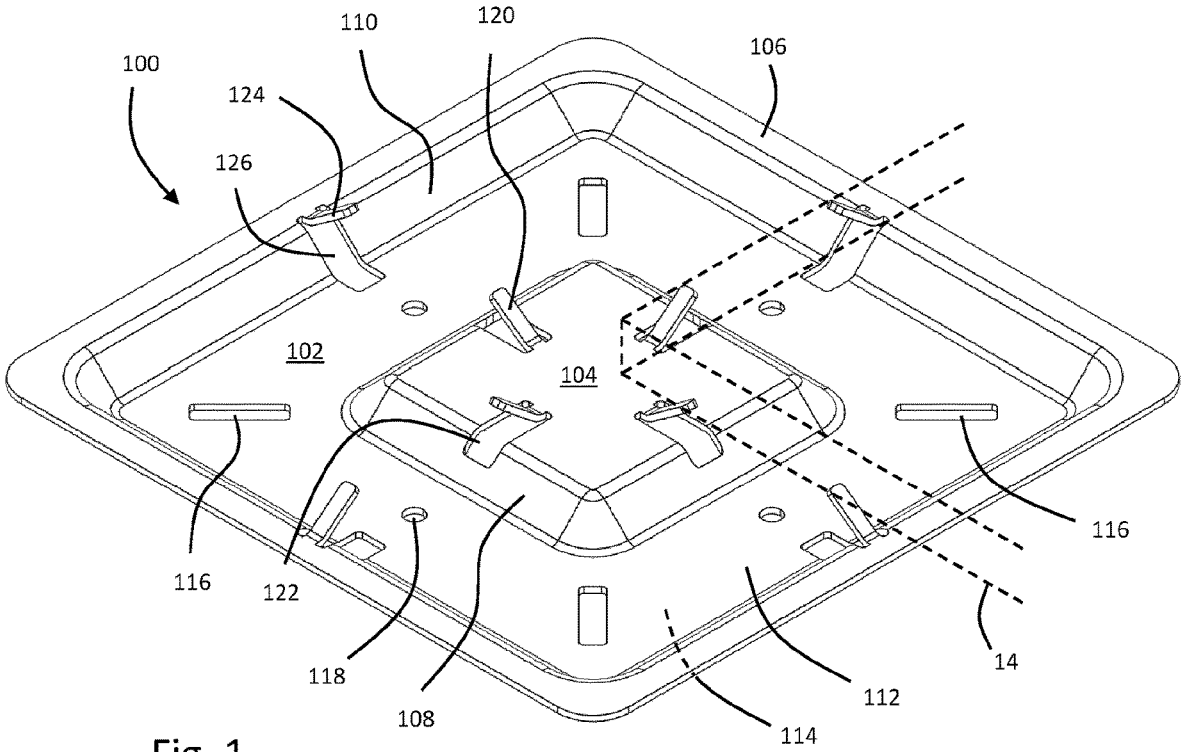
FIG. 1 is a perspective view of a first paving support base in accordance with the present invention.
Figure 2:
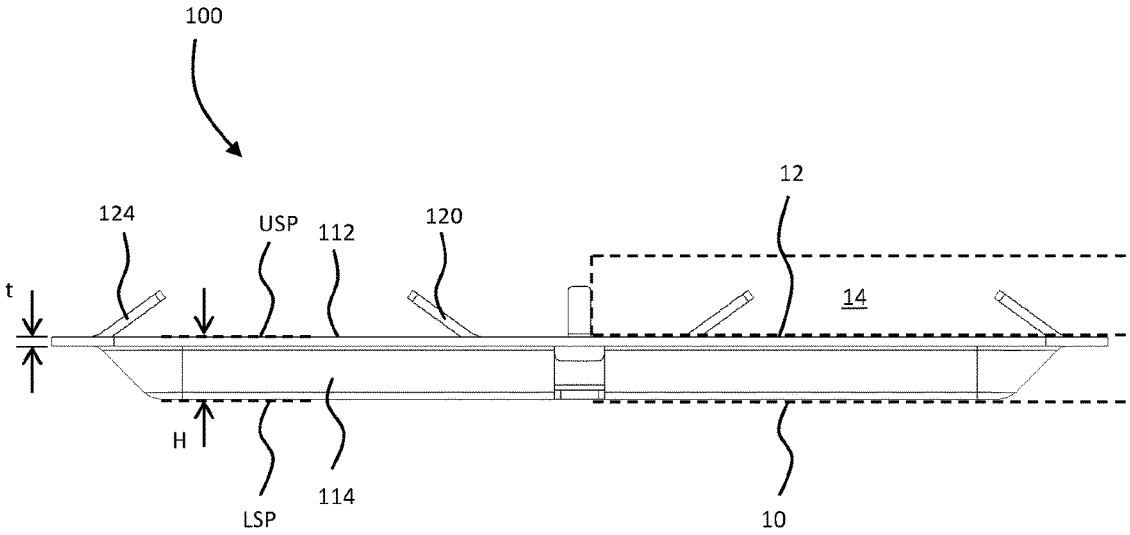
FIG. 2 is a side view of the support base of FIG. 1.
Figure 3:
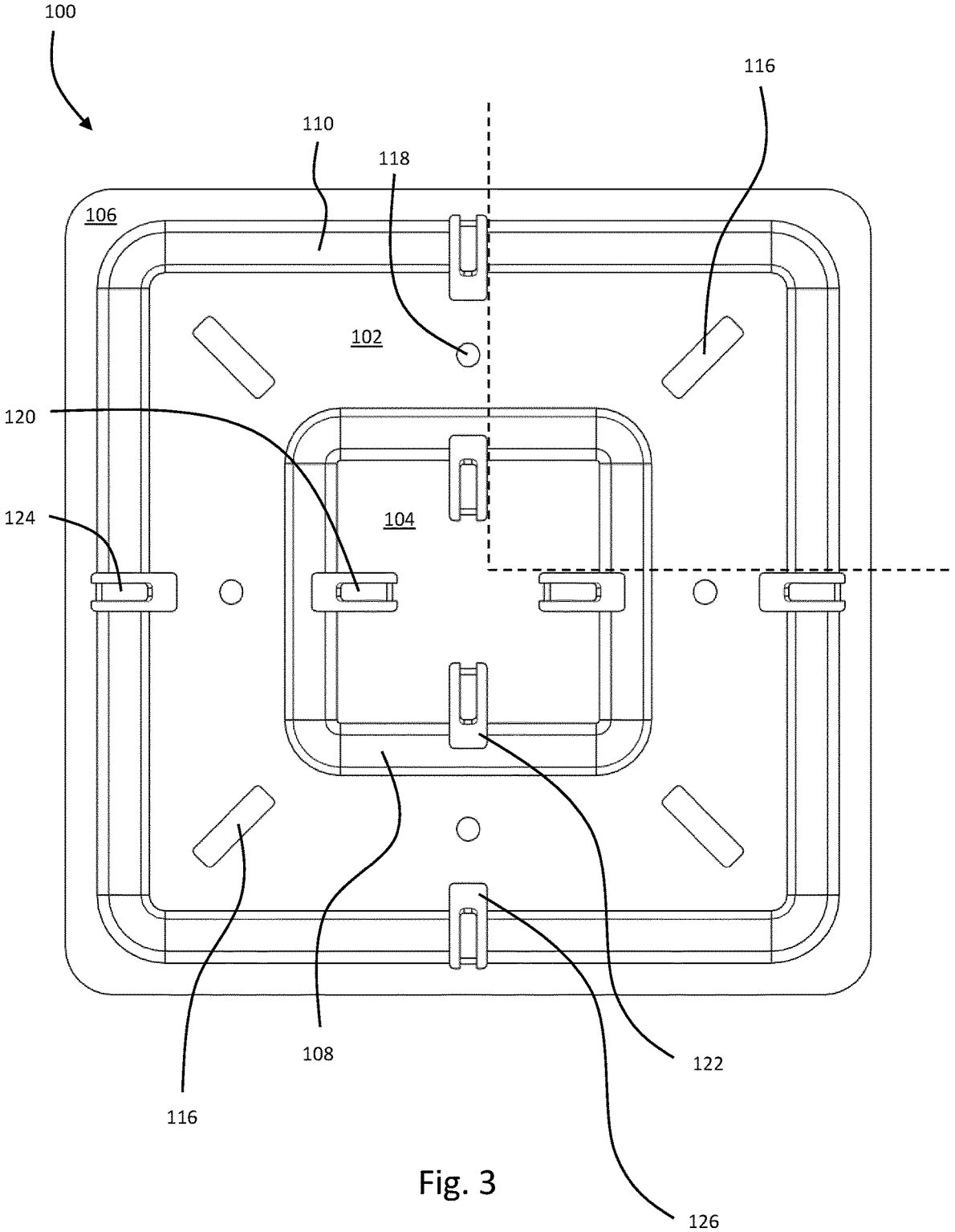
FIG. 3 is a plan view of the support base of FIG. 1.

Turning to FIGS. 1 to 3, the flooring support base 100 is a substantially flat, pressed metal component which is square in plan. The base 100 is constructed from a pressed metal material having a thickness t.

The base 100 is formed to have a base portion 102, a central support portion 104 and a perimeter support portion 106. The base portion 102 is connected to the central support portion 104 by an inner transition 108. The base portion 102 is connected to the perimeter support portion 104 by an outer transition 110. The inner and outer transitions 108, 110 are at approximately 45 degrees to the portions 102, 104, 106 which are horizontal and parallel to each other. This provides the base 100 with a 'dish-like' shape having a central 'island'. Being constructed from a flat, planar piece of material, the base 100 (and therefore each of the portions) has an upper surface 112 and a lower surface 114.

The base portion 102 is in the shape of a square annulus, surrounding the central support portion 104 and surrounded by the perimeter support portion 106. The base portion 102 comprising four slots 116 each extending proximate a corner of its inner permitter (adjacent the inner transition 108) towards a corner of its outer perimeter (adjacent the outer transition 110). Four circular openings 118 are provided at the centre of each side of the base portion 102.

The central portion 104 defines four tabs 120, each extending radially outwardly to a midpoint on each side of the central portion. The tabs 120 are formed with a U-shaped cut forming an opening 122 in the material of the base 100 and the tab 120 deformed upwardly so as to project from the upper surface 112 at an angle. The openings 122 formed by creation of the tabs 120 extend from the central portion 104 into the inner transition 108.

The perimeter support portion 106 defines four tabs 124, each extending radially inwardly to a midpoint on each side of the base portion 102. The tabs 124 are formed with a U-shaped cut forming an opening 126 in the material of the base 100 and the tab 124 deformed upwardly so as to project from the upper surface 112 at an angle. The openings 126 formed by creation of the tabs 124 extend from the perimeter support portion 106 into the outer transition 110.

As such, the inner tabs 120 face outwardly, and the outer tabs 124 face inwardly.

Turning to FIG. 2, it can be seen that the upper surface 112 of the central support portion 104 and perimeter support portions 106 are parallel and aligned, providing an upper support plane USP. The lower surface 114 of the base portion 102 forms a lower support plane LSP. The vertical height H of the support between LSP and USP with respect to the base 100 is 10 mm in this embodiment.

In the first configuration, the base 100 can be used alone to provide a 10 mm support height between an underlying substrate 10 and the lower surface 12 of a paving slab 14. The base 100 may be attached to the substrate 10 using mechanical fasteners (e.g. screws) through the slots 116 or openings 118. Once fixed in position, slabs 14 may be supported on the base 100 as shown in FIG. 1. A plurality of bases are provided in a grid formation on the substrate 10, and paving slabs 14 laid on top. Each base may support the corners of four slabs. The tabs 120, 124 provide a fixed separation distance between each slab. The tabs 120, 124 should not project above the upper surface of the slabs 14, and may be deformed with a tool such as pliers to ensure that their free ends remain below the upper surface.

Second Support Configuration

The second configuration is provided for support heights above 10 mm, but below 20 mm. Turning to FIG. 4, a shim 200 is provided. The shim 200 is a square plate of sheet metal material having thickness st=1.5 mm. The shim 200 has filleted corners 202, and at the centre of each side a radially inwardly extending slot 204. The slots do not meet in the middle (they are discrete) such that the shim 200 remains intact.

Figure 5:
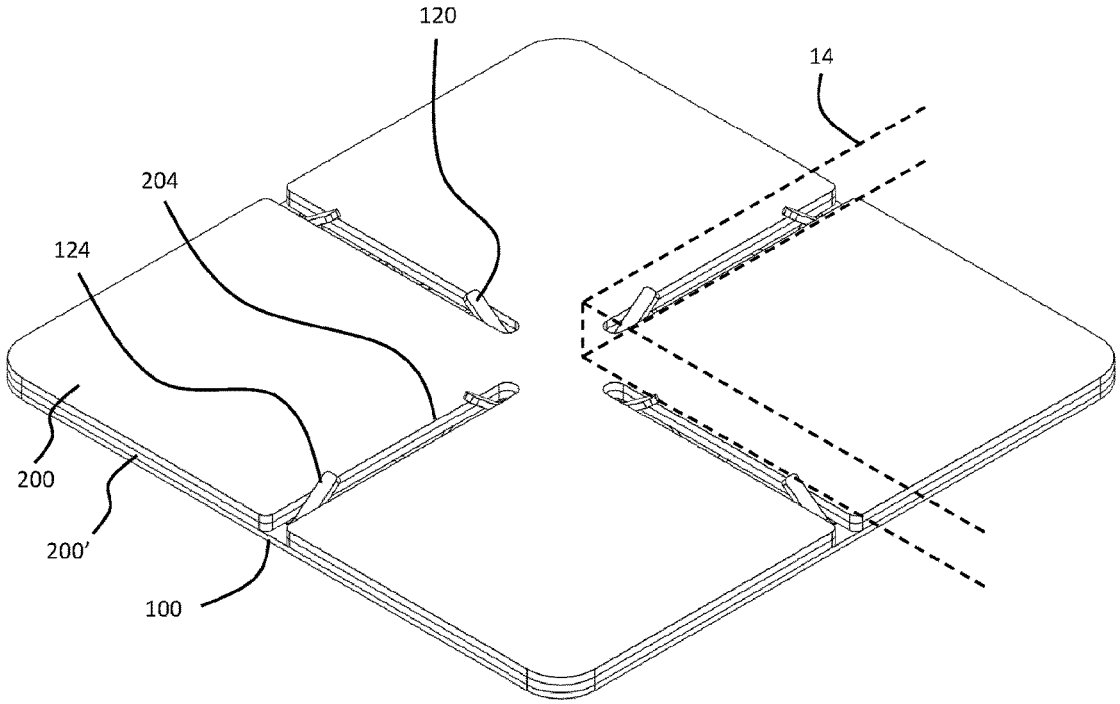
FIG. 5 is a perspective view of a first support comprising the support base of FIG. 1 assembled with two of the shim plates of FIG. 4.

The second configuration is achieved by assembling between one and four shims 200 with the base 100. Referring to FIG. 5, two shims 200 and 200' have been assembled with the base 100. The shims 200, 200' are placed on top of the base 100 such that their outer perimeters align. The tabs 120, 124 of the base 100 penetrate and extend through the slots 204 to extend above the upper surface of the top shim 200.

Figure 6:
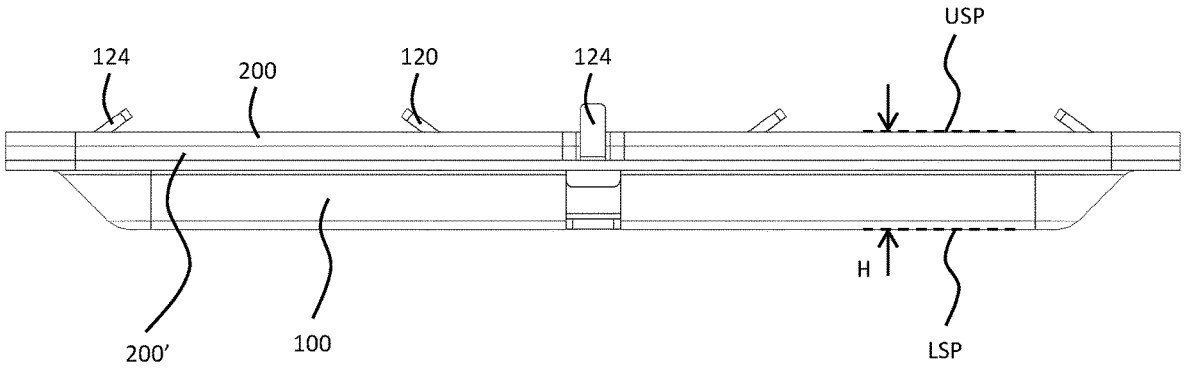
FIG. 6 is a side view of the support of FIG. 5.

This increases the height H between LSP and USP by N×2 mm (where N is the number of shims 200). So in this example, per FIG. 6, H=10+(2×2)=14 mm. It will be noted that the tabs 120, 124 extend from the top of the highest shim, and if they do not they can be deformed to do so. A paving slab 14 can be positioned as per the first configuration.

Third Support Configuration

Figure 7:
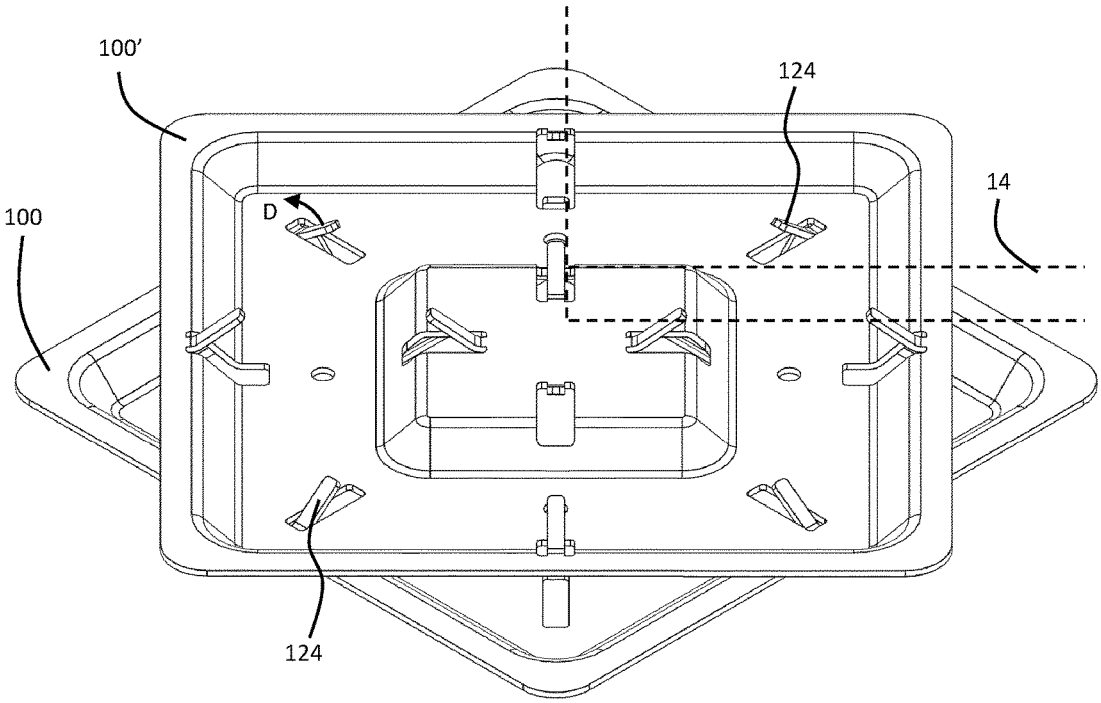
FIG. 7 is a perspective view of a second support comprising two of the support bases shown in FIG. 1.
Figure 8:
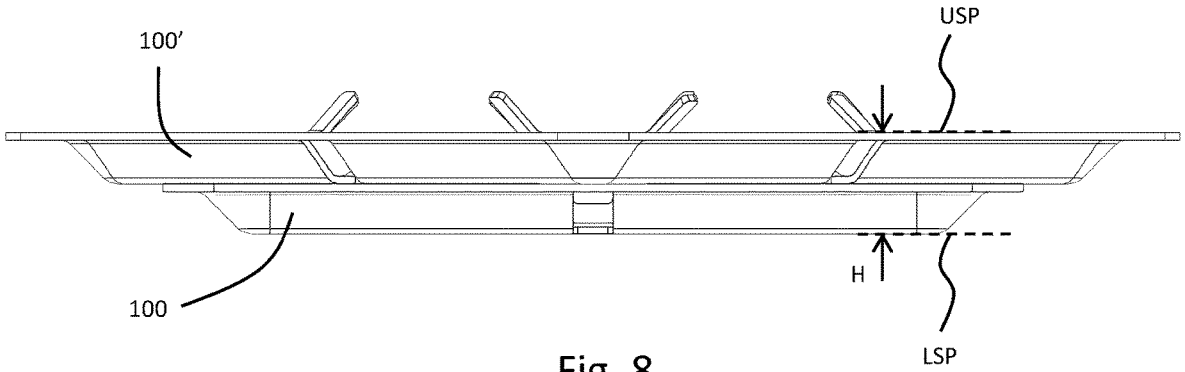
FIG. 8 is a side view of the support of FIG. 7.
Figure 9:
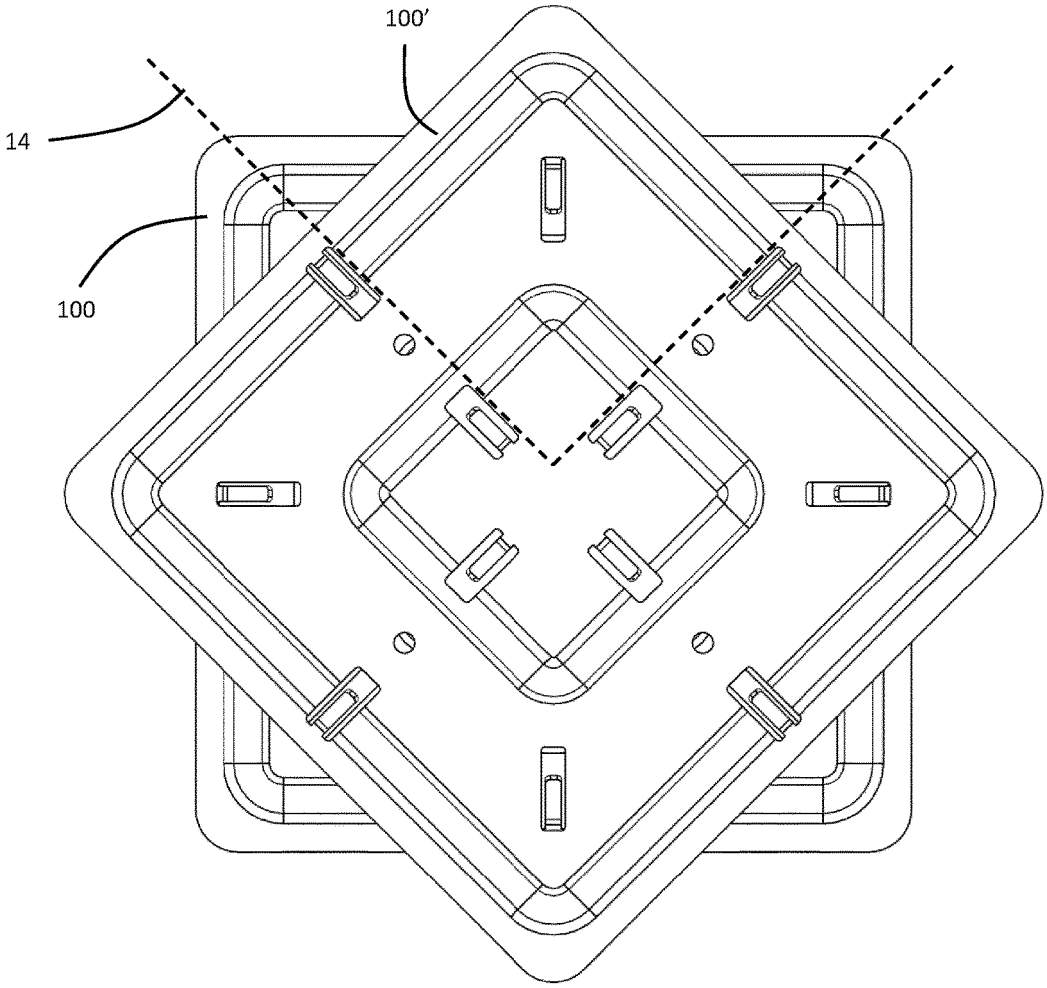
FIG. 9 is a plan view of the support of FIG. 7.

For heights of 20 mm, rather than utilising N=5 shim plates, a further base 100' is provided, as shown in FIGS. 7 to 9. The base 100' is stacked on top of the base 100 but rotated by 45 degrees. In this position, the lower surface 114' of the base portion 102' contacts the upper surface 112 of the perimeter support portion 106 such that H=20 mm (see FIG. 8).

The inner tabs 120 of the lower base 100 nest within the recess formed by the central support portion 104' of the base 100'. The outer tabs 124 of the lower base enter the slots 116 and hold the top base 100' relative to the bottom base 100 in the horizontal plane. Vertical securing of the bases 100, 100' is facilitated by deforming the tabs 124 by rotating them in direction D until they contact the upper surface of the base 100'. This locks the bases 100, 100' together. Because each base is 10 mm high, H=20 mm.

Fourth Support Configuration

Figure 10:
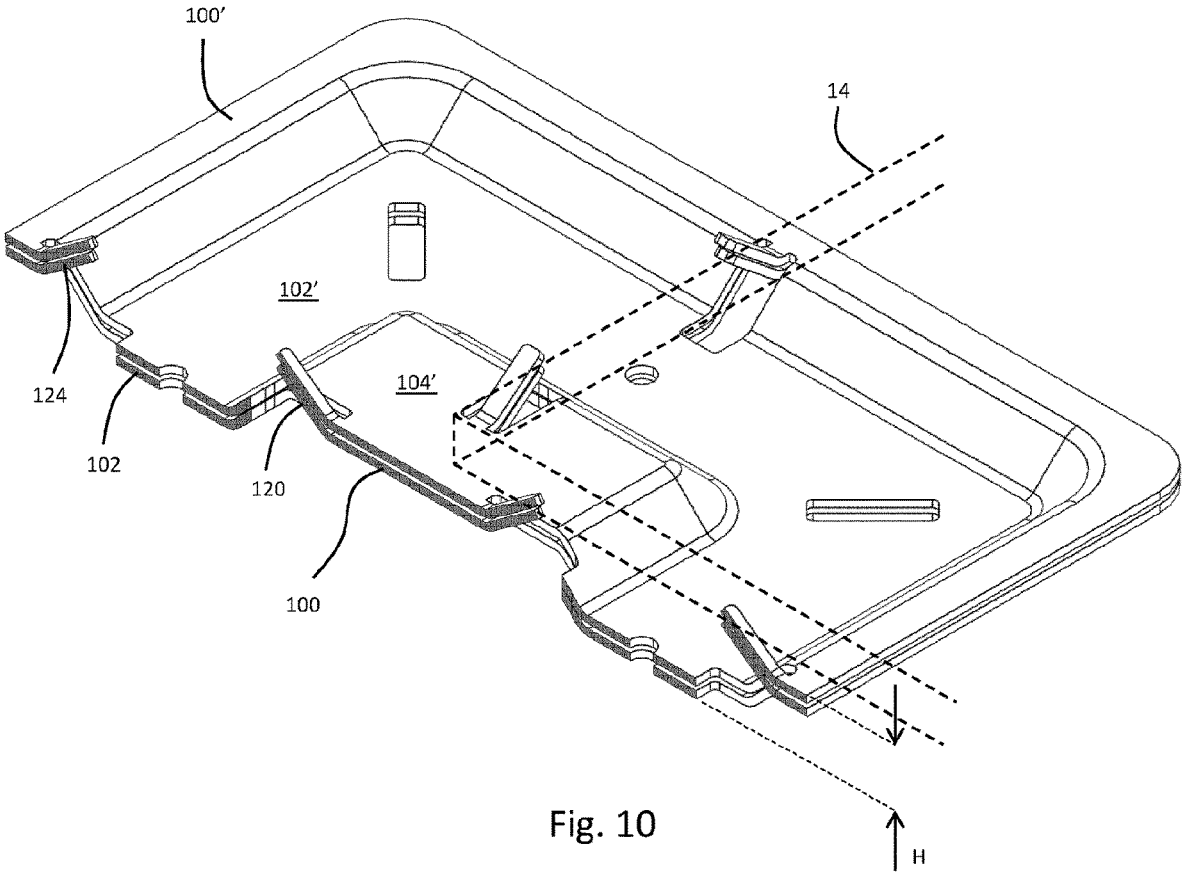
FIG. 10 is a perspective, exploded view of a third paving support according to the invention.

Turning to FIG. 10, instead of using the shims 200 per the second configuration, to reduce part variability, the bases 100 may simply be aligned and stacked on top of each other to increase the support height H by 2 mm. Two bases 100, 100' are shown (similar to the third configuration), but instead of the upper base 100' being rotated through 45 degrees relative to the lower base 100, the bases are aligned at 0 degrees.

This allows them to mate, or nest, with the raised central support portion 104 of the lower base 100 entering the cavity formed by the central support portion 104' of the upper base. Similarly, the downwardly projecting base portion 102' of the upper base 100' nests into the recess formed by the base portion 102 of the lower base 100.

Although the thickness of the bases t=1.5 mm, the incremental height increase is 2 mm because the 45 degree transitions 108, 110 abut to provide a slight clearance between the horizontal parts of the bases 100, 100'.

It will also be noted that the tabs 120, 124 of the lower base 100 project into the openings 122', 126' formed by the tabs of the upper base 100'.

Further bases may be staked to further increase H by 2 mm as required.

In one variation of the above embodiment, stacked bases could be used in conjunction with shim plates.

DESCRIPTION OF THE SECOND EMBODIMENT

Figure 11:
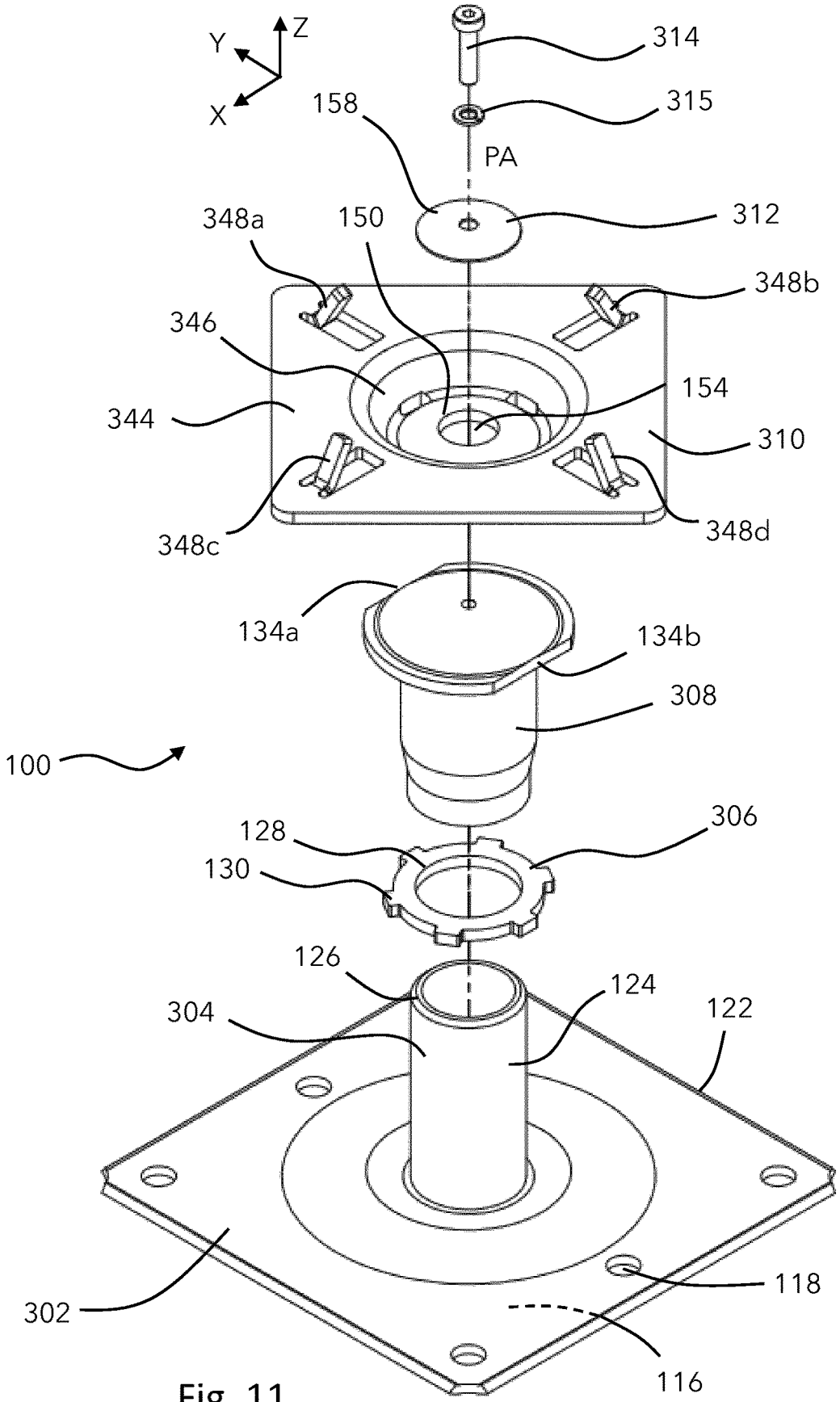

Referring to FIG. 11 there is shown a pedestal 300 according to the present invention. The pedestal 300 comprises a base plate 302, a base shaft 304, a locking nut 306, a head shaft 308, a flooring support base 310, a friction locking member 312, a mechanical fastener 314 and a spring washer 315.

Details of the pedestal will not be described in detail, suffice to say that the flooring support base 310 is supported vertically offset from the base plate 302 to support a plurality of paving slabs.

The flooring support base 310 is a generally flat, square component (other shapes are possible) having an outer annular portion 344 and an inner, shaped portion 346. The annular portion 344 defines four tabs **348*a*-348*d*, each of which are constructed from outwardly facing U-shaped openings in the material of the flooring support base 310. As such, the tabs can be bent upwardly and radially outwardly to extend from the upper surface of the flooring support base 310**.

In use, flooring members are positioned on top of the flooring support base 310 as required. The tabs **348*a* act as spacers between the flooring members in the same way as the base 100**.

The invention claimed is:

1. A support for a plurality of flooring members, the support comprising:

a first flooring support component defining an upper support surface, a lower support surface, a plurality of tabs projecting upwardly to serve as flooring member abutments in use, a first plurality of openings, and a second plurality of openings;

wherein the first flooring support component is shaped such that:

when a second flooring support component identical to the first flooring support component is stacked onto the first flooring component in a first angular orientation, the first flooring support component and the second flooring support component nest together to provide a first support height between the lower support surface of the first flooring support component and the upper support surface of the second flooring support component with the plurality of tabs of the first flooring support component engaged in the first plurality of openings of the second flooring support component; and, when a second flooring support component identical to the first flooring support component is stacked onto the first flooring component in a second angular orientation, different to the first angular orientation, there is a second support height, greater than the first support height, between the lower support surface of the first flooring support component and the upper support surface of the second flooring support component with the plurality of tabs of the first flooring support component engaged in the second plurality of openings of the second flooring support component.

2. The support according to claim 1, wherein the first flooring support component is square in cross-section and comprises four side edges, and wherein the plurality of tabs comprises four tabs, each of the four tabs defined mid-way along and inboard of each side edge of the first flooring support component.

3. The support according to claim 1, wherein the first flooring support component is square in cross-section and comprises four side edges, and wherein the plurality of tabs comprises four pairs of tabs, each of the four pairs of tabs being aligned mid-way along and inboard of each side edge, each of the four pairs of tabs comprising an inner tab and an outer tab.

4. The support according to claim 3, wherein the plurality of tabs project at an angle from the upper surface of the first flooring support component in use, wherein each pair of tabs comprises an inner tab and an outer tab, the inner tab being inboard of the outer tab relative to the respective side edge, and wherein the inner and outer tabs project towards each other.

5. The support according to claim 4, wherein the plurality of tabs project at 45 degrees to the upper surface of the first flooring support component in use.

6. The support according to claim 1, wherein the first flooring support component comprises a raised inner portion defining part of the flooring support surface, and a raised outer portion defining part of the flooring support surface, the raised inner portion and the raised outer portion being separated by an annular portion.

7. The support according to claim 1, wherein the tabs are constructed from locally deformed portions of the first flooring support component.

8. The support according to claim 7, wherein the plurality of tabs are constructed from U-shaped cuts in the first flooring support component, and the plurality of tabs being bent upwardly.

9. The support according to claim 8, wherein the U-shaped cuts form the first plurality of openings.

10. The support according to claim 1, wherein the first support component is constructed from a sheet material.

11. The support according to claim 1, wherein the first angular orientation and the second angular orientation are oriented at 45 degrees to each other.

12. The support according to claim 1, wherein the first flooring support component comprises a perimeter support portion and a base support portion, the perimeter support portion surrounding the base support portion and being offset therefrom and configured such that:

when a second flooring support component identical to the first flooring support component is stacked onto the first flooring component in the first angular orientation, the base support portion of the second flooring support component enters the perimeter support portion of the first flooring support component; and, when a second flooring support component identical to the first flooring support component is stacked onto the first flooring component in the second angular orientation, the base support portion of the second flooring support component abuts the perimeter support portion of the first flooring support component.

13. A support according to claim 1, wherein the tabs are deformable to enable two flooring support components to be locked together by deformation of the tabs of the lower flooring support component projecting through the further set of openings of the upper flooring support component.

14. A support according to claim 1 comprising:

a base comprising a ground-contact surface;

a structure extending normally to the ground-contact surface;

wherein the first support component is mounted to the structure such that the first support component is offset from the base to provide an elevated flooring support surface.

15. The support according to claim 1, comprising:

a first shim defining a support surface for placement of a flooring member and comprising a plurality of shim openings;

wherein the first shim is stacked on top of the first flooring support such that the plurality of tabs project through the shim openings to retain the first shim relative to the first flooring support, the plurality of tabs forming flooring member abutments projecting from the support surface of the first shim.

16. The support according to claim 15, comprising:

a second shim positioned stacked between the first flooring support and the first shim, the second shim being identical to the first shim.

17. The support according to claim 15, wherein the first flooring support component is square in cross-section and comprises four side edges, and wherein the plurality of tabs comprises four tabs, each of the four tabs defined mid-way along and inboard of each side edge of the first flooring support component.

18. A kit for forming a flooring support, the kit comprising:

a plurality of the first flooring support components according to claim 1.

19. A method of supporting a plurality of flooring members, the method comprising the step of:

forming a plurality of spaced apart flooring supports, each flooring support comprising one or more of the first flooring support components according to claim 1, the flooring supports being formed by selecting one or more of the first flooring support components, and stacking the first flooring support components to the desired height by orienting them in the first or second angular orientation;

placing a plurality of flooring members on the plurality of flooring supports.

* * * * *